US007204113B1

(12) United States Patent
Ghiran et al.

(10) Patent No.: US 7,204,113 B1
(45) Date of Patent: Apr. 17, 2007

(54) PUNCH FOR HYDROFORMING DIE

(75) Inventors: Mike M. Ghiran, Lake Orion, MI (US); Susan Ng, Flint, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/536,705

(22) Filed: Sep. 29, 2006

(51) Int. Cl.
*B21D 28/28* (2006.01)
*B21D 26/02* (2006.01)

(52) U.S. Cl. ..... 72/55; 72/58; 83/53; 83/54; 83/22

(58) Field of Classification Search ..... 72/55, 72/56, 57, 58, 59, 60, 63, 370.27; 83/24, 83/25, 54, 53, 98, 100, 108, 188
See application file for complete search history.

(56) References Cited

U.S. PATENT DOCUMENTS 5,666,840 A * 9/1997 Shah et al. ..... 72/55
5,765,420 A * 6/1998 Schaefer ..... 72/55
5,799,524 A * 9/1998 Schafer et al. ..... 72/55
5,816,089 A * 10/1998 Marando ..... 72/55
5,974,846 A * 11/1999 Ash ..... 72/55
6,067,830 A * 5/2000 Klages et al. ..... 72/55
6,305,201 B1 * 10/2001 Ghiran et al. ..... 72/55
6,470,546 B1 * 10/2002 Bonny et al. ..... 72/370.27
6,591,648 B1 * 7/2003 Ash et al. ..... 72/55
6,658,908 B1 * 12/2003 Ghiran et al. ..... 72/55
6,681,611 B2 * 1/2004 Haag et al. ..... 72/370.27
7,021,098 B2 * 4/2006 Griskiewitz et al. ..... 72/55

* cited by examiner

*Primary Examiner*—David B. Jones
(74) *Attorney, Agent, or Firm*—Laura C. Hargitt

(57) ABSTRACT

A punch for a hydroforming die includes a body, a neck extending axially from the body, a head extending axially from the neck and having a diameter less than a diameter of the body and a thumbnail slot extending axially and radially into the head to allow fluid within a tubular member to force a wall portion of the tubular member outward into the slot of the punch and be sheared by the punch to produce an opening in the tubular member.

24 Claims, 6 Drawing Sheets

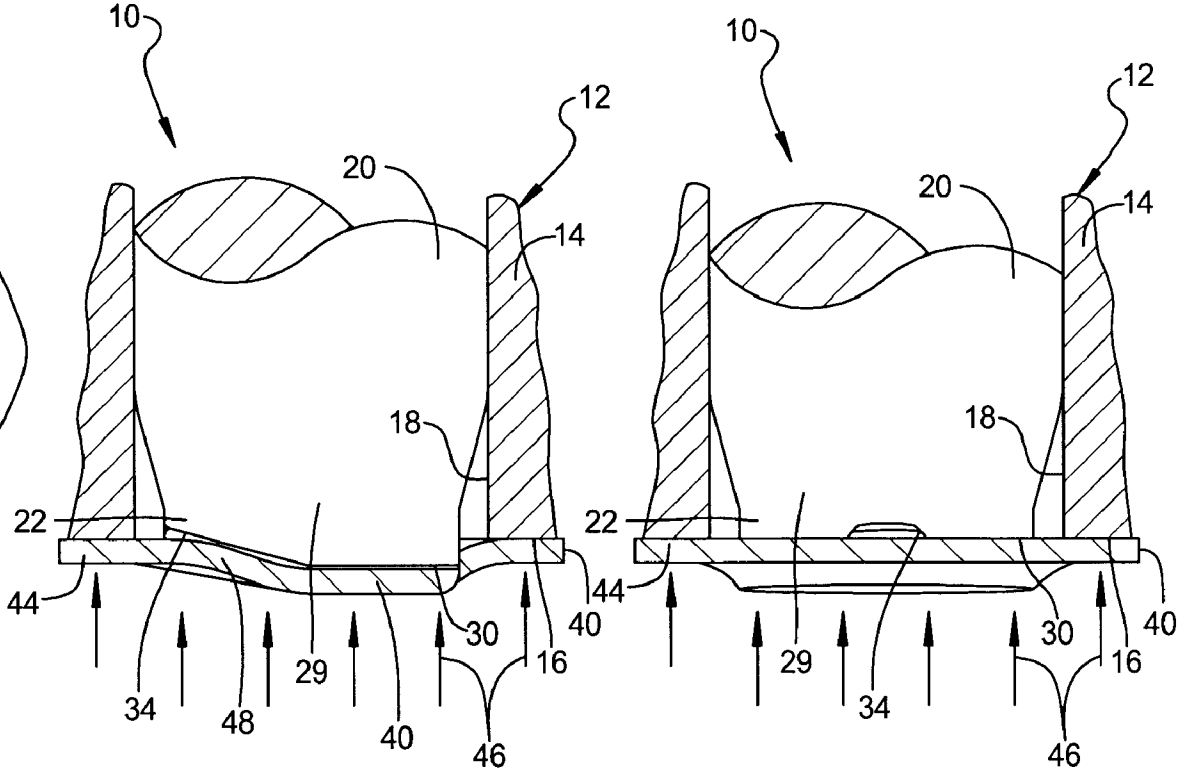
FIG 5B
FIG 5A
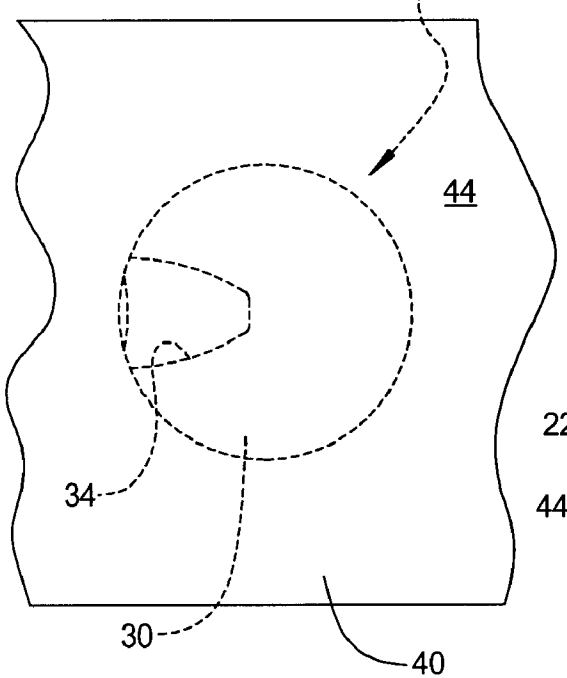
FIG 5

PUNCH FOR HYDROFORMING DIE

TECHNICAL FIELD

The present invention relates generally to hydroforming and, more specifically, to a punch for a hydroforming die.

BACKGROUND OF THE INVENTION

It is known to form a cross-sectional profile of a tubular member by a hydroforming process in which a fluid-filled tubular member is placed within a cavity of a die and then the die is closed so that the tubular member is pinched within the die. Fluid pressure is then increased inside the tubular member to expand the tubular member outwardly against the cavity of the die to provide a tubular member having a die formed cross-sectional profile.

During tube hydroforming, large size punches of various shapes are used to create desired openings in the tubular member by piercing. The large punches currently used, necessitate similarly large activating hydraulic cylinders in order to overcome the forces needed for piercing. Large bore hydraulic cylinders need high volume of oil flow to operate.

Using the hydroforming process, the piercing operation is performed within the die. One method of piercing used in hydroforming applications is "hydrapiercing". Upon completion of hydroforming, the tubular member is in intimate contact with the wall of the die. The hydroforming fluid is at a forming pressure, approximately 10,000 psi. A punch is attached to a hydraulic actuated cylinder. As the water pressure reaches its peak, the cylinder is activated to move the punch to pierce the required hole for the tubular member, allowing the metal to be sheared and produce a slug.

In this operation, it is important not to loose water pressure when the tubular member is being hydroformed and pierced, otherwise, the tubular member will collapse. Presently, to overcome the loss in pressure during piercing, all hydraulic actuated cylinders must pierce simultaneously or in clusters of two or more at a time, with minimal time there between. Any small variation in hydraulic cylinder oil flow, forming pressure, hydraulic cylinder oil pressure, wall thickness, or hardness will interfere with the timing in hydraulic cylinder movement, thereby allowing some openings to be pierced before or after the programmed sequence. This ultimately contributes to uncontrolled leakage areas, which will contribute to non-repeatable tubular member definition and in most cases to the complete collapse of the tubular member resulting in scrap.

As a result, it is desirable to provide a punch to pierce openings in a tubular member during the hydroforming process. It is also desirable to provide a punch that can leave a clean pierce through the material of the tubular member. It is further desirable to provide a punch that is able to provide good slug retention as well as move the slug away from the opening. It is still further desirable to provide a punch that is able to prevent the loss of water pressure as multiple openings are being created by the punch. Therefore, there is a need in the art to provide a new punch for a hydroforming die that meets these desires.

SUMMARY OF THE INVENTION

Accordingly, the present invention is a punch for a hydroforming die including a body, a neck extending axially from the body, and a head extending axially from the neck and having a diameter less than a diameter of the body. The punch also includes a thumbnail slot extending axially and radially into the head to allow fluid within a tubular member to force a wall portion of the tubular member outward into the slot of the punch and be sheared by the punch to produce an opening in the tubular member.

One advantage of the present invention is that a punch is provided for a hydroforming die having greater sealing ability. Another advantage of the present invention is that the punch improves the quality of an opening created in a tubular member during hydroforming. Yet another advantage of the present invention is that the punch provides better slug retention during hydroforming. Still another advantage of the present invention is that the punch provides cleaner piercing through the material of the tubular member. A further advantage of the present invention is that the punch aids in sustaining water pressure as it pierces during hydroforming. Yet a further advantage of the present invention is that the punch results in less down time in the hydroforming process. Still a further advantage of the present invention is that the punch results in significant improvement in scrap reduction during hydroforming. Another advantage of the present invention is that the punch reduces the cost of hydroforming.

Other features and advantages of the present invention will be readily appreciated, as the same becomes better understood, after reading the subsequent description taken in conjunction with the accompanying drawings.

BRIEF DESCRIPTION OF THE DRAWINGS

FIG. 5 is a bottom elevational view of a tubular member and the punch of FIG. 1 illustrating a second step of a piercing process.

FIG. 5A is a fragmentary front elevational view of the tubular member and the punch of FIG. 1 illustrating a second step of a piercing process.

FIG. 5B is a fragmentary side elevational view of the tubular member and the punch of FIG. 1 illustrating a second step of a piercing process.

DESCRIPTION OF THE PREFERRED EMBODIMENT

Figure 1:
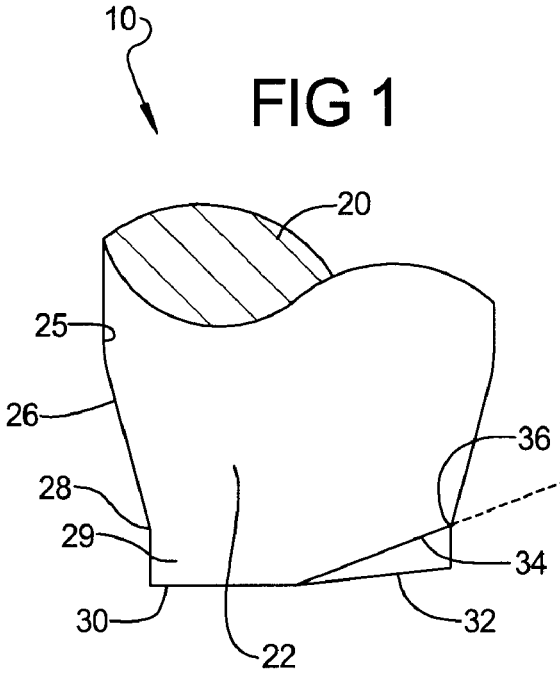
FIG. 1 is a front elevational view of a punch, according to the present invention.
Figure 4B:
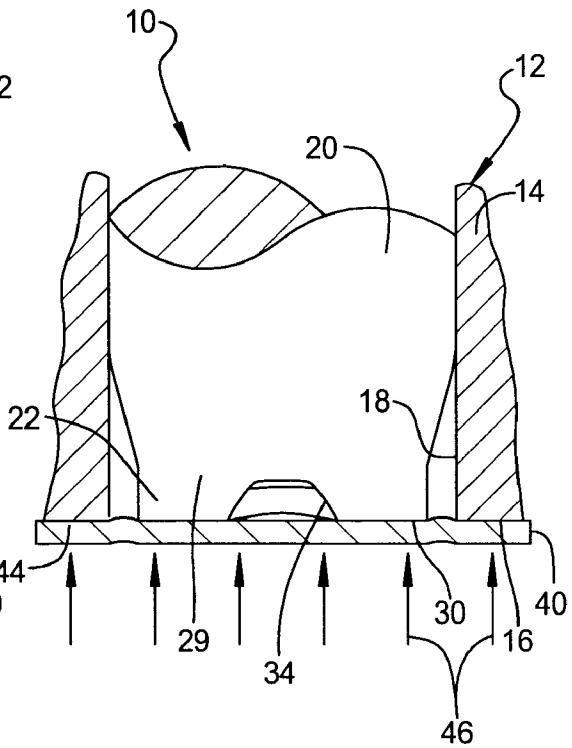
FIG. 4B is a fragmentary side elevational view of the tubular member and the punch of FIG. 1 illustrating a first step of a piercing process.
Figure 4A:
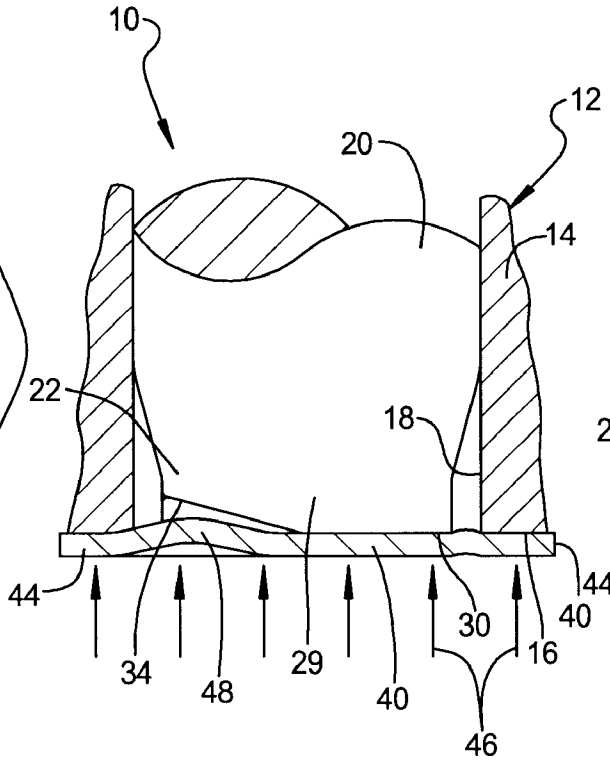
FIG. 4A is a fragmentary front elevational view of the tubular member and the punch of FIG. 1 illustrating a first step of a piercing process.

Referring to the drawings and in particular FIG. 1, one embodiment of a punch 10, according to the present invention, is generally shown for a hydroforming die, generally indicated at 12 and partially shown in FIGS. 4A and 4B. The hydroforming die 12 is a die set comprised of a lower die half and an upper die half, only one of which is shown at 14. The die half 14 includes a tubular forming cavity portion 16 (partially shown). The die half 14 includes a cavity 18 extending axially from the tubular forming cavity portion 16 for the punch 10 to be described.

The punch 10 includes a body 20 disposed within the cavity 18 of the die half 14. The body 20 extends axially and is generally cylindrical in shape. The body 20 has a generally circular cross-sectional shape and a predetermined diameter. In one embodiment, the body 20 has a predetermined diameter of twenty-seven millimeters (27 mm).

The punch 20 also includes a neck 22 extending axially from the body 20. The neck 22 has a diameter decreasing axially from a diameter of the body 20. The neck 22 has an outer radius 25 extending axially and circumferentially, an incline 26 extending axially and radially inwardly, and an inner radius 28 extending axially and circumferentially. In one embodiment, the outer radius 25 is about twenty-five millimeters (25 mm) and the inner radius 28 is about five millimeters (5 mm). In one embodiment, the incline 26 is at an angle of approximately fifteen degrees (15°) relative to a longitudinal axis of the body 20.

The punch 10 includes a head 29 extending axially from the neck 22. The head 29 extends axially a predetermined distance and has a predetermined diameter. The head 29 has a diameter less than a diameter of the body 20. In one embodiment, the head 29 extends axially a predetermined distance of about five millimeters (5 mm) and has a predetermined diameter of about twenty-one millimeters (21 mm). The head 29 includes an end surface 30 that is generally planar.

Figure 1A:
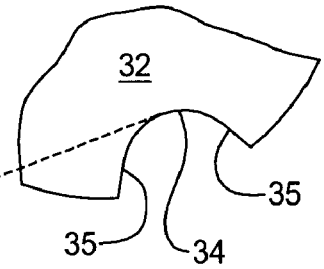
FIG. 1A is an exploded view of a portion of the punch of FIG. 1.
Figure 2:
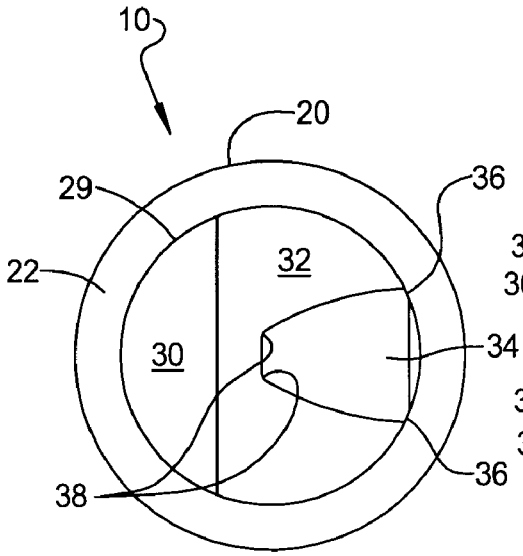
FIG. 2 is a bottom elevational view of the punch of FIG. 1.
Figure 3:
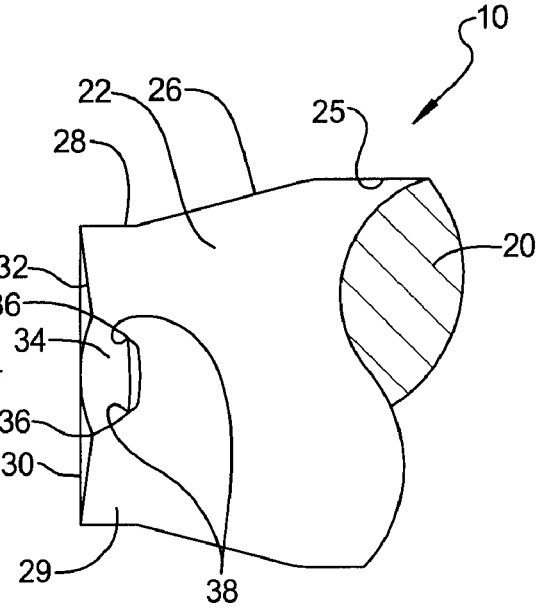
FIG. 3 is a side elevational view of the punch of FIG. 1.

The head 29 also includes a thumbnail surface 32 that is inclined axially away from the end surface 30 at a predetermined angle such as approximately five degrees (5°). The head 29 further includes a thumbnail slot 34 extending radially and axially into the thumbnail surface 32. In one embodiment, the thumbnail slot 34 extends away from the end surface 30 at a predetermined angle such as approximately twenty degrees (20°). In one embodiment, the thumbnail slot 34 has cutting edges 35 (FIG. 1A) at a face angle of approximately thirty degrees (30°) from a centerline thereof. The thumbnail slot 34 includes a chamfer 36 of a predetermined angle for a predetermined length and a predetermined width. In one embodiment, the chamfer 36 has a predetermined angle of approximately forty-five degrees (45°), a predetermined length of about two millimeters (2 mm), and a predetermined width of about one millimeter (1 mm). The thumbnail slot 34 includes bottom corners 38 of a predetermined radius and predetermined distance therebetween. In one embodiment, the bottom corners 38 have a predetermined radius of about three millimeters (3 mm) and a predetermined distance therebetween of about two millimeters (2 mm). It should be appreciated that the difference in angles between the thumbnail surface 32 and thumbnail slot 34 is approximately fifteen degrees (15°). It should also be appreciated that the size of the thumbnail slot 34 is proportioned to the diameter of the punch 10 and wall thickness of material to be pierced. It should further be appreciated that, in the case of an oval punch, the size of the thumbnail slot 34 is proportioned to the width of the slot 34 and thickness of material to be pierced.

The punch 10 is made of a rigid material such as metal. The punch 10 is a monolithic structure being integral, unitary, and one-piece. It should be appreciated that the punch 10 is movable relative to the die half 14.

Figure 4:
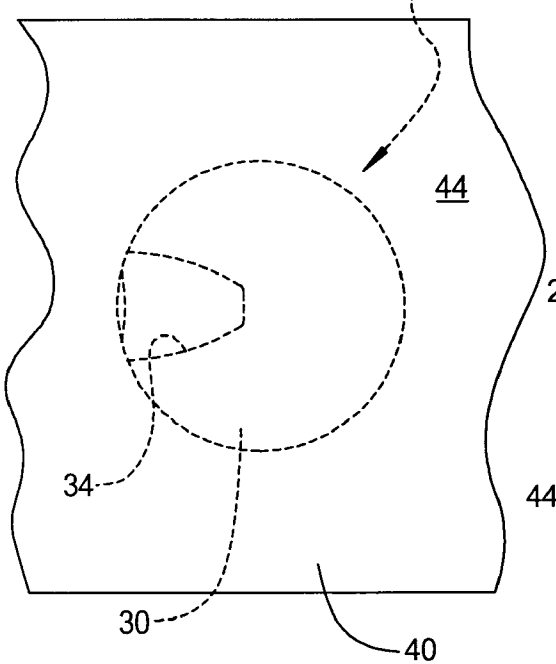
FIG. 4 is a bottom elevational view of a tubular member and the punch of FIG. 1 illustrating a first step of a piercing process.

In operation, the punch 10 is disposed in the cavity 18 of the die half 14. A tubular member 40 is disposed in the cavity portion 16 of the die half 14. The punch 10 is used to produce an opening or hole 42 in a wall 44 of the tubular member 40. As illustrated in FIGS. 4, 4A, and 4B, the punch 10 is operatively connected to a hydraulic actuated cylinder (not shown) and the punch 10 is raised by the cylinder such that the head 29 engages the wall 44 of the tubular member 40.

Referring to FIGS. 4A and 4B, hydroforming fluid 46 (indicated by arrows) in the tubular member 40 is pressurized to a forming pressure of approximately 10,000 psi. At this time, the tubular member 40 is formed and takes the shape of the cavity portion 16 by becoming in intimate contact with all surfaces of the cavity portion 16 including the end surface 30 of the head 29 of the punch 10. During hydroforming, a small bulge or projection 48 will form inside the thumbnail slot 34. It should be appreciated that this bulging effect caused by the forming pressure allows a slug 50 to be described to remain firmly attached to the wall 44 for the opening 42.

Upon completion of hydroforming, the tubular member 40 is in intimate contact with the wall of the cavity portion 16 of the die 12 and the head 29 of the punch 10. The hydraulic actuated cylinder moves the punch 10 forward toward the tubular member 40. During the forward movement of the punch 10, the hydroforming fluid 42 is forcing a wall portion 48 of the tubular member 40 to stay in intimate contact with the end surface 30 of the punch 10 and follow the movement of the punch 10 as illustrated in FIGS. 5, 5A, and 5B. As the punch 10 continues to advance through the wall 44 of the tubular member 40, the punch 10 pierces the opening 42. The five degree (5°) angle on the thumbnail surface 32 of the punch 10 will allow the slug 50 to begin to be cut from the opposite extremity of the thumbnail slot 34 while allowing the bulge 48 to further form into the thumbnail slot 34.

Figures 6, 6A, 6B:
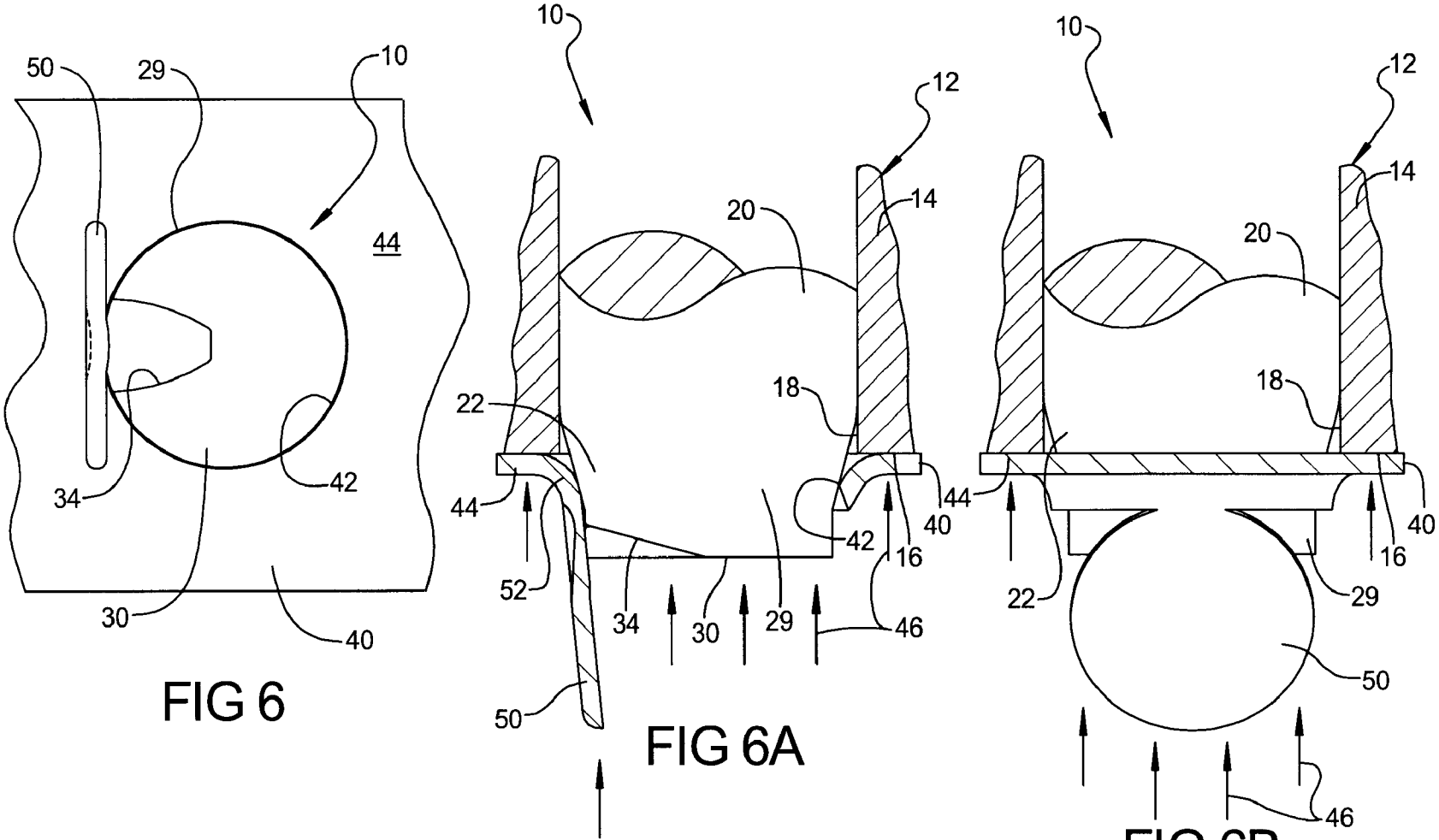
FIG. 6 is a bottom elevational view of a tubular member and the punch of FIG. 1 illustrating a third step of a piercing process.
FIG. 6A is a fragmentary front elevational view of the tubular member and the punch of FIG. 1 illustrating a third step of a piercing process.
FIG. 6B is a fragmentary side elevational view of the tubular member and the punch of FIG. 1 illustrating a third step of a piercing process.

During this process, the two cutting edges 35 on the outside extremity of the thumbnail slot 34 will also start cutting into a hinged area 52 of the tubular member 40. Along with the gradual cutting by the two cutting edges 35, the slug 50 will also gradually bend as illustrated in FIGS. 6, 6A, and 6B. It should be appreciated that, after the piercing cycle, the length of the slug 50 will end up being significantly shorter yet strongly attached to the edge of the opening 42. It should also be appreciated that, to further protect the slug 50 from being sheared off, the chamfer 36 is added to the bottom outside edge of the thumbnail slot 34.

Figure 7B:
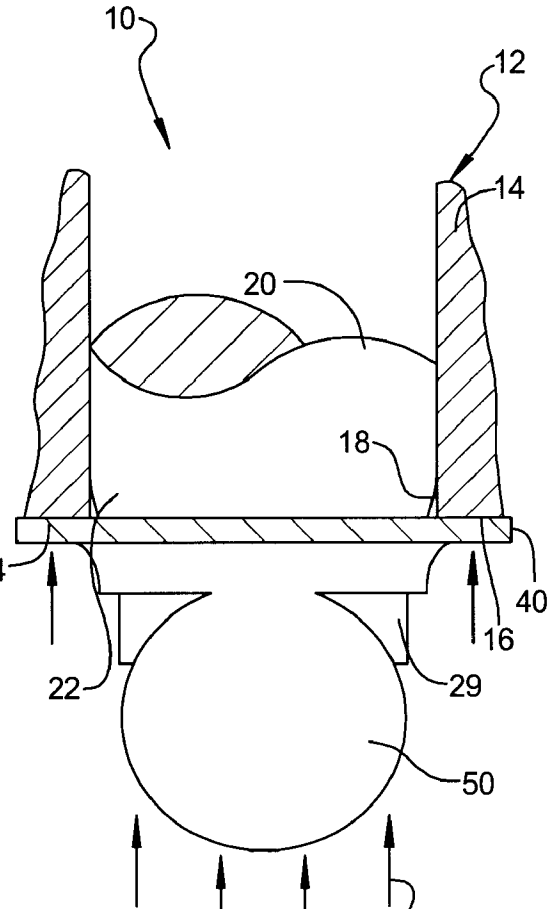
FIG. 7B is a fragmentary side elevational view of the tubular member and the punch of FIG. 1 illustrating a fourth step of a piercing process.
Figure 7A:
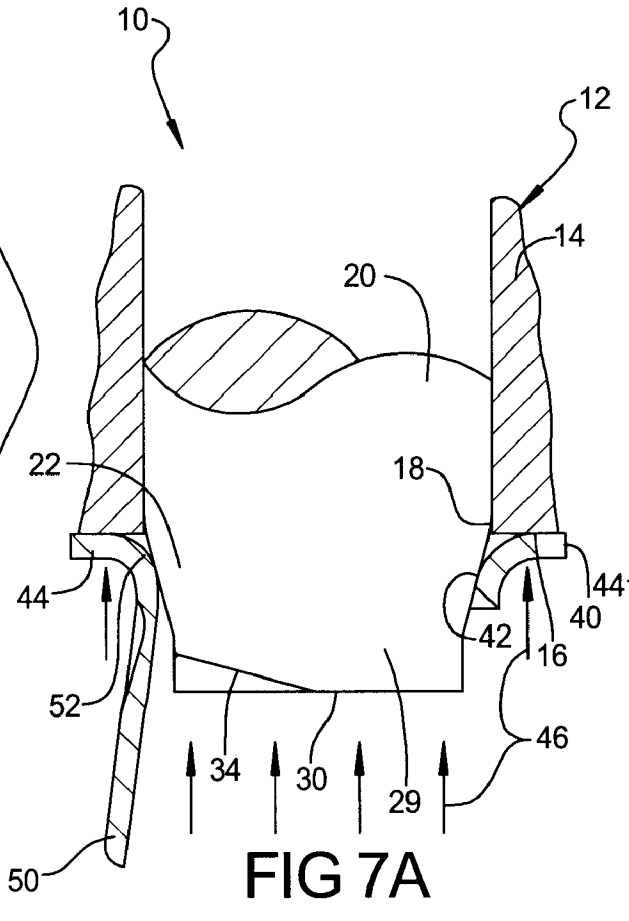
FIG. 7A is a fragmentary front elevational view of the tubular member and the punch of FIG. 1 illustrating a fourth step of a piercing process.
Figure 7:
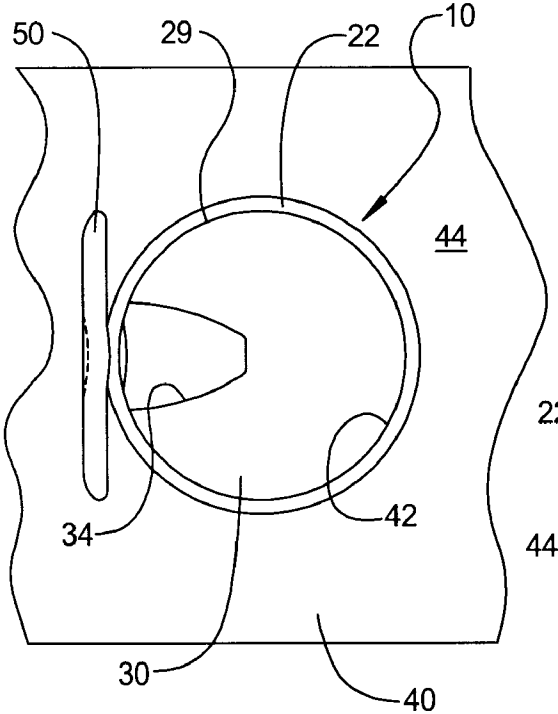
FIG. 7 is a bottom elevational view of a tubular member and the punch of FIG. 1 illustrating a fourth step of a piercing process.
Figures 8, 8A, 8B:
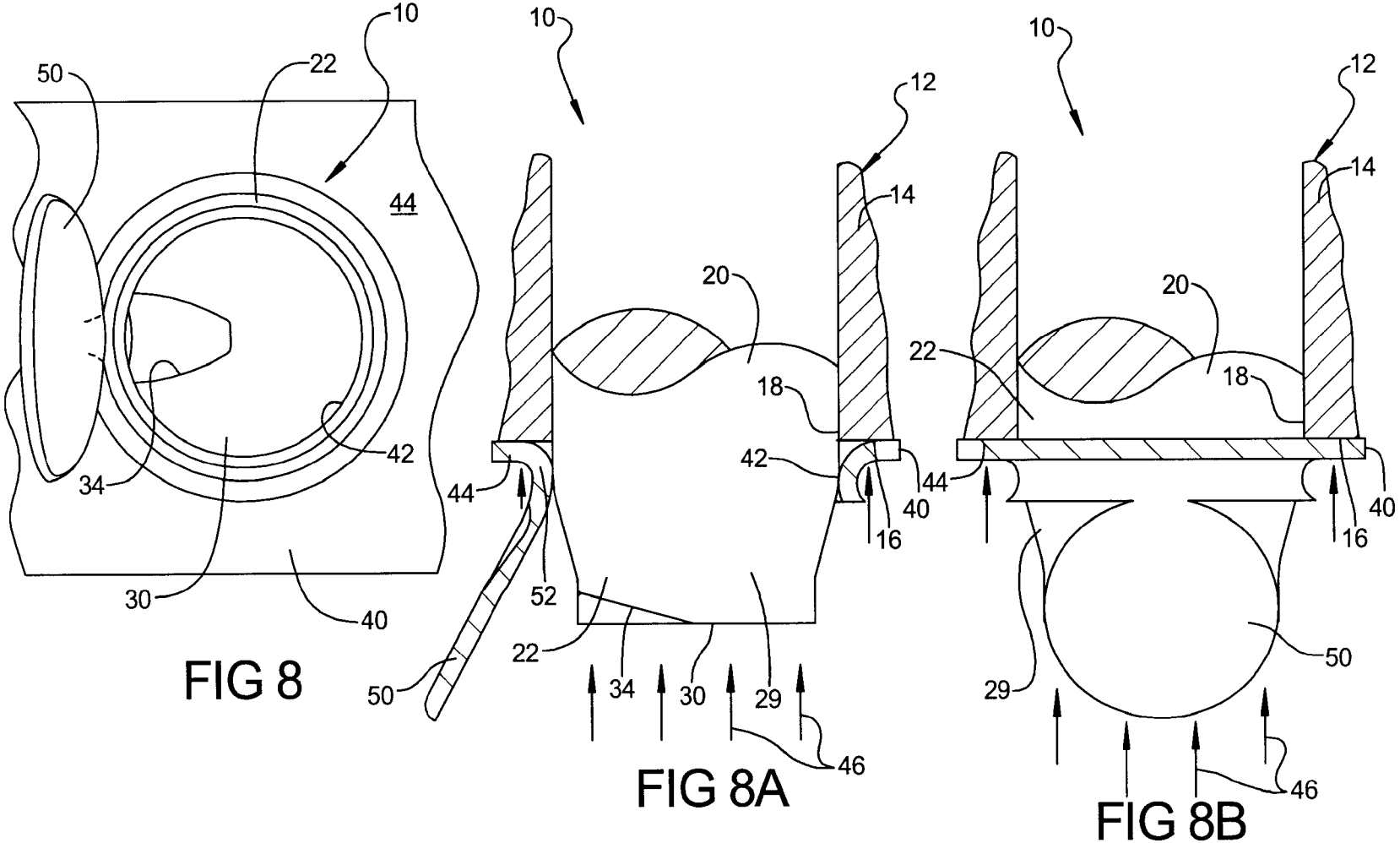
FIG. 8 is a bottom elevational view of a tubular member and the punch of FIG. 1 illustrating a final step of a piercing process.
FIG. 8A is a fragmentary front elevational view of the tubular member and the punch of FIG. 1 illustrating a final step of a piercing process.
FIG. 8B is a fragmentary side elevational view of the tubular member and the punch of FIG. 1 illustrating a final step of a piercing process.

As illustrated in FIGS. 6, 6A, and 6B, the punch 10 bends the slug 50 to a ninety degree (90°) angle. After bending the slug 50 to a ninety degree (90°) angle, the material in the hinged area 52 will become work hardened more than the remaining area of the opening 42 and have the tendency to resist further forming. The thumbnail slot 34 advantage over the chamfer 36 is the difference in the length of the flat created by the bending in the area, which in the case of the thumbnail slot 34 is approximately 50% less than known conventional punches which use a simple forty-five degree (45°) chamfer at the front edge of the punch to attach the slug. Therefore, during the process, the thumbnail slot 34 will push a very small amount of material in a non-uniform manner, allowing the opening 42 to form with no obstructions by forming a seal around the punch 10 as illustrated in FIGS. 7, 7A, and 7B. The punch 10 continues forward to bend the slug 50 beyond a ninety degree (90°) angle as illustrated in FIGS. 8, 8A and 8B.

After piercing, the tubular member 40 is depressurized, the punch 10 retracted, and the die 12 is opened. It should be appreciated that the slug 50 will remain attached to the wall 42 of the tubular member 40.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A punch for a hydroforming die comprising:

a body;

a neck extending axially from said body;

a head extending axially from said neck and having a diameter less than a diameter of said body; and a thumbnail slot extending axially and radially into said head to allow fluid within a tubular member to force a wall portion of the tubular member outward into said slot of said punch and be sheared by said punch to produce an opening in the tubular member.

2. A punch as set forth in claim 1 wherein said neck portion includes an outer radius, an inner radius, and an incline extending axially and radially inward between said outer radius and said inner radius.

3. A punch as set forth in claim 1 wherein said head includes an end surface being planar.

4. A punch as set forth in claim 3 wherein said head includes a thumbnail surface extending axially away from said end surface at an angle greater than zero.

5. A punch as set forth in claim 4 wherein said thumbnail slot extends axially away from said thumbnail surface at an angle greater than zero.

6. A punch as set forth in claim 2 wherein said thumbnail slot has a pair of opposed chamfers.

7. A punch as set forth in claim 6 wherein said chamfers have an angle greater than an angle of said incline.

8. A punch as set forth in claim 1 wherein said thumbnail slot has a pair of corners spaced radially.

9. A punch as set forth in claim 1 wherein said body, said neck, and said head are a monolithic structure being integral, unitary, and one-piece.

10. A hydroforming die assembly comprising:

at least one die half having a die forming cavity and a punch cavity extending axially therein and communicating with said die forming cavity; and a punch being disposed in said punch cavity and operatively supported by said at least one die half, said punch having a body, a neck extending axially from said body, a head extending axially from said neck, and a thumbnail slot extending axially and radially into said head for piercing an opening in a tubular member disposed against said at least one die half.

11. A hydroforming die assembly as set forth in claim 10 wherein said neck includes an outer radius, an inner radius, and an incline extending axially and radially inward between said outer radius and said inner radius.

12. A hydroforming die assembly as set forth in claim 10 wherein said head includes an end surface being planar.

13. A hydroforming die assembly as set forth in claim 12 wherein said head includes a thumbnail surface extending axially away from said end surface at an angle greater than zero.

14. A hydroforming die assembly as set forth in claim 13 wherein said thumbnail slot extends axially away from said thumbnail surface at an angle greater than zero.

15. A hydroforming die assembly as set forth in claim 11 wherein said thumbnail slot has a pair of opposed chamfers.

16. A hydroforming die assembly as set forth in claim 15 wherein said chamfers have an angle greater than an angle of said incline.

17. A hydroforming die assembly as set forth in claim 11 wherein said thumbnail slot has a pair of corners spaced radially.

18. A hydroforming die assembly as set forth in claim 11 wherein said body, said neck, and said head are a monolithic structure being integral, unitary, and one-piece.

19. A method of forming an opening in a tubular member with a hydroforming die assembly, said method comprising the steps of:

providing a hydroforming die assembly having at least one die half and a punch operatively supported by the die half and having a body, a neck extending axially from the neck, and a thumbnail slot extending axially and radially into the head;

disposing a tubular member adjacent the die half;

pressurizing the tubular member with hydroforming fluid;

moving the punch relative to the tubular member; and forming an opening in the tubular member.

20. A method as set forth in claim 19 including the step of forcing a wall of the tubular member inward.

21. A method as set forth in claim 20 including the step of shearing the wall of the tubular member to form the opening in the tubular member.

22. A method as set forth in claim 21 including the step of producing a slug sheared from the wall of the tubular member.

23. A method as set forth in claim 22 including the step of releasing the pressure in the tubular member and opening the die.

24. A method as set forth in claim 23 including the step of retaining the slug on the wall of the tubular member.

* * * * *